US006168156B1

(12) United States Patent
Gonzalez

(10) Patent No.: US 6,168,156 B1
(45) Date of Patent: Jan. 2, 2001

(54) DOMINO BOX KIT AND DOMINO STANDS

(75) Inventor: Raymond Gonzalez, 7752 NW. 71 St., Miami, FL (US) 33166

(73) Assignee: Raymond Gonzalez, Miami, FL (US)

( * ) Notice: Under 35 U.S.C. 154(b), the term of this patent shall be extended for 0 days.

(21) Appl. No.: 09/075,137

(22) Filed: May 8, 1998

Related U.S. Application Data

(60) Provisional application No. 60/048,283, filed on Jun. 2, 1997.

(51) Int. Cl.[7] ..... A63F 1/10; A63F 9/20

(52) U.S. Cl. ..... 273/148 A; 273/148 R; 273/309; 206/315; 220/4.26; 220/4.32

(58) Field of Search ..... 273/148 A, 148 R, 273/285, 287, 272, 309; 206/315; 220/4.26, 4.32

(56) References Cited

U.S. PATENT DOCUMENTS 1,685,723 * 9/1928 Robins ..... 273/272
2,364,007 * 11/1944 Stanton ..... 220/4.26
2,774,598 * 12/1956 Strocco ..... 273/285
3,503,612 * 3/1970 Singer ..... 273/272
4,453,714 * 6/1984 Houser ..... 273/148 A
5,586,764 * 12/1996 Katz ..... 273/293

* cited by examiner

*Primary Examiner*—Benjamin H. Layno

(57) ABSTRACT

A domino box kit (20) (shown in FIG. 1, FIG. 2 and FIG. 3) comprises a sectionalized base (29) which has a recessed area for storing a plurality of domino game tiles (26), a score book (37), and a writing instrument (38), and a sectionalized cover (30). The base (29) (shown in FIG. 4) has two sections. A base section (23) has a male slidable track member (40) and a base section (24) has a female slidable track member (41) for connecting the base sections by a male and female slidable track system. The cover (30) (shown in FIG. 5) has two sections. A cover section (21) has a male slidable track member (42) and a cover section (22) has a female slidable track member (43) for connecting the cover sections by a male and female slidable track system. The base sections (23) and (24) and the cover sections (21) and (22) (shown in FIG. 6) are used as domino stands for supporting the domino game tiles (26) while the game is being played. Both the base sections (23) and (24) and the cover sections (21) and (22) are reassembled after playing to form the domino box (20) (shown in FIG. 1).

11 Claims, 6 Drawing Sheets

DOMINO BOX KIT AND DOMINO STANDS

CROSS-REFERENCE TO RELATED APPLICATIONS

This Appln claims the benefit of Provisional No. 60/048,283 filed Jun. 2, 1997.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to a domino box kit for double six, nine, mah-jongg and other domino games to store and carry the domino game tiles, domino stands, a score book and a writing instrument within the domino box. Modern society is demanding multiple-use products that can be practical, economical and easier to use.

The domino games double six, nine, twelve and other domino games like the mah-jongg Chinese game usually have a box to store and carry the domino games tiles, but the domino stands, score book and the writing instrument are stored and carried separately.

BRIEF SUMMARY OF THE INVENTION

This invention is directed to a domino box kit for storing and carrying the domino game tiles, domino stands, score book and a writing instrument within the domino box.

The first object of the present invention is to provide a domino box that transforms into four domino stands for supporting the domino game tiles while the game is being played.

Another object of the invention is to provide a domino box kit for storing and carrying the domino games tiles, domino stands, score book and the writing instrument within the box for easy transportation.

A further object of the invention is to provide a domino box which includes a window at each end to show the domino game tiles and the color contrast between them and the domino box.

A domino box kit comprises: a base formed by two sections which has a recessed area for storing and carrying a plurality of domino game tiles, a score book and a writing instrument within the box, and a cover formed by two sections. The base sections and the cover sections, collapsing the domino box, are used as domino stands for supporting the domino game tiles while the game is played.

LIST OF REFERENCE NUMERALS

Figure 1:
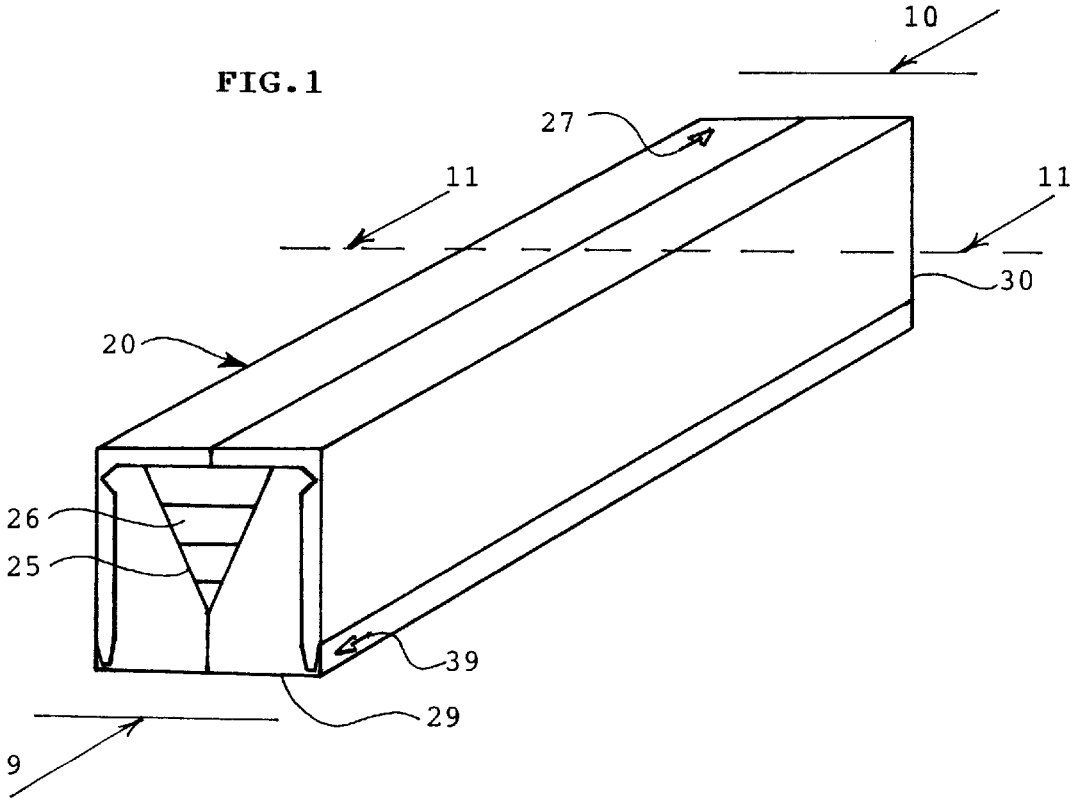
FIG. 1 is a perspective view of the domino box in its transportation position, showing a plurality of domino tiles through a window.

20 Domino box kit
21 Cover section
22 Cover section
23 Base section
24 Base section
25 Triangle window
26 Domino game tiles
27 Arrow on the cover
29 Base
30 Cover
31 Upper slidable male track member
32 Upper slidable female track member
33 Bottom slidable male track member
34 Bottom slidable female track member
35 Female half moon lock member
36 male half moon lock member
37 Score book
38 Writing instrument
39 Arrow on the base
40 Male track member
41 Female track member
42 Male slidable track member
43 Female slidable track member
44 Domino engaging groove—base stand
45 Front lip of the groove—base stand
46 Angle of the groove—base stand
47 Horizontal section or base—base stands
48 Vertical section or support base stands
49 Top edge
50 Domino tiles stopper
51 Top surface of the base
52
53 Front edge of the base
54 Horizontal section or base—cover stands
55 Vertical section or support—cover stands
56 Domino engaging groove—cover stands

DETAILED DESCRIPTION OF THE INVENTION

A typical embodiment of a domino box kit 20 of the present invention is shown in FIG. 1. The domino box 20 has a rectangular shaped body, an arrow 27 on the top surface of a cover 30 indicates the cover sliding opening position. A base 29 of the box 20 has a triangle window 25 at each end to show a plurality of domino game tiles 26 as well as the color contrast between them and the domino box 20.

Figure 2:
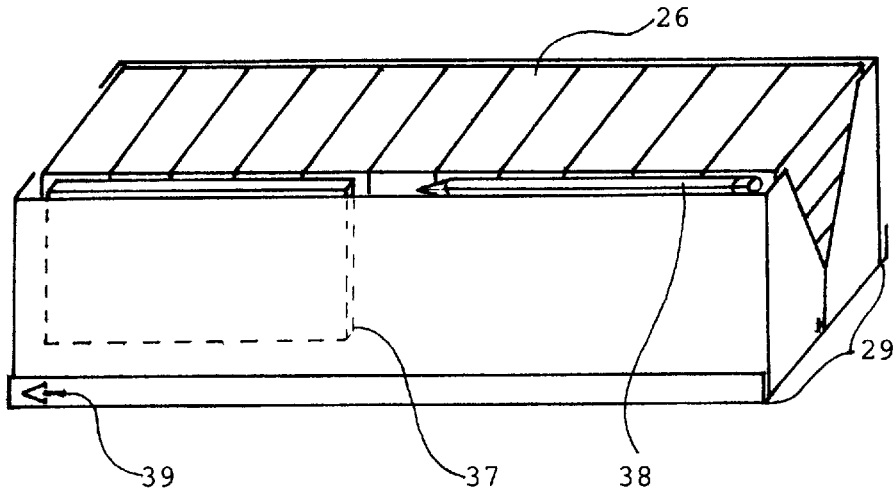
FIG. 2 is a perspective view of the base, carrying a plurality of domino game tiles, a score book and a writing instrument.
Figure 3:
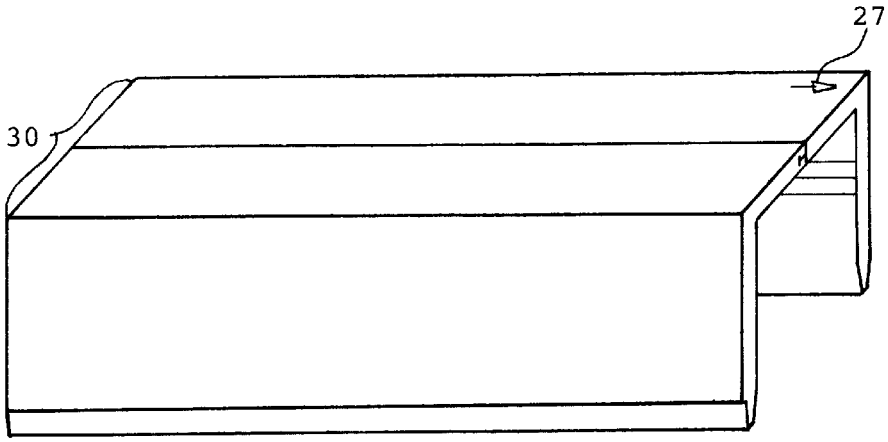
FIG. 3 is a perspective view of the cover of the box.
Figure 6:
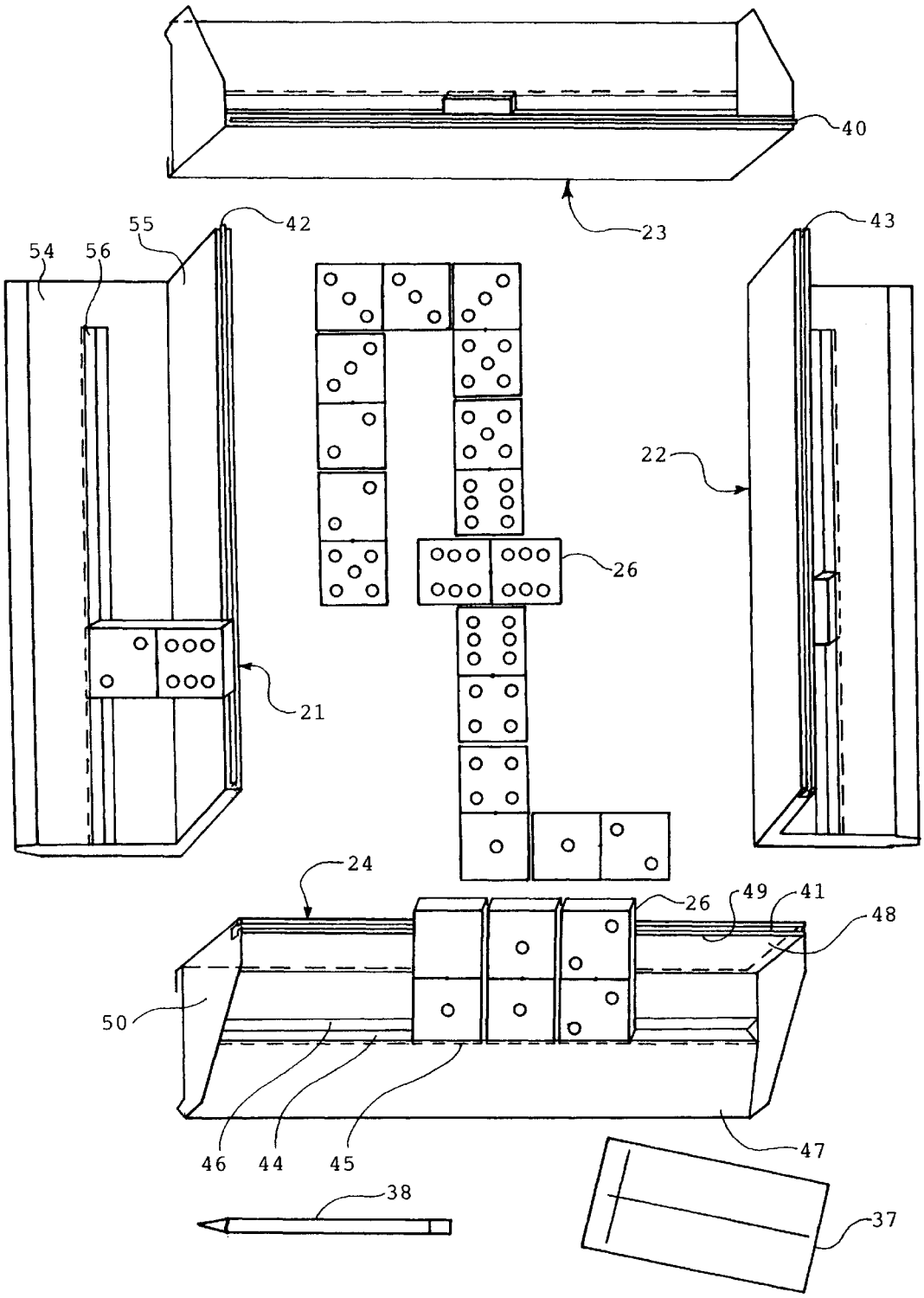
FIG. 6 is a perspective view, showing a number of the game's apparatus embodying the present invention.

The domino box 20, shown in open position in FIG. 2 and FIG. 3, stores and carries inside the domino game tiles 26, a score book 37 and a writing instrument 38, also shown in playable position in FIG. 6.

Figure 9:
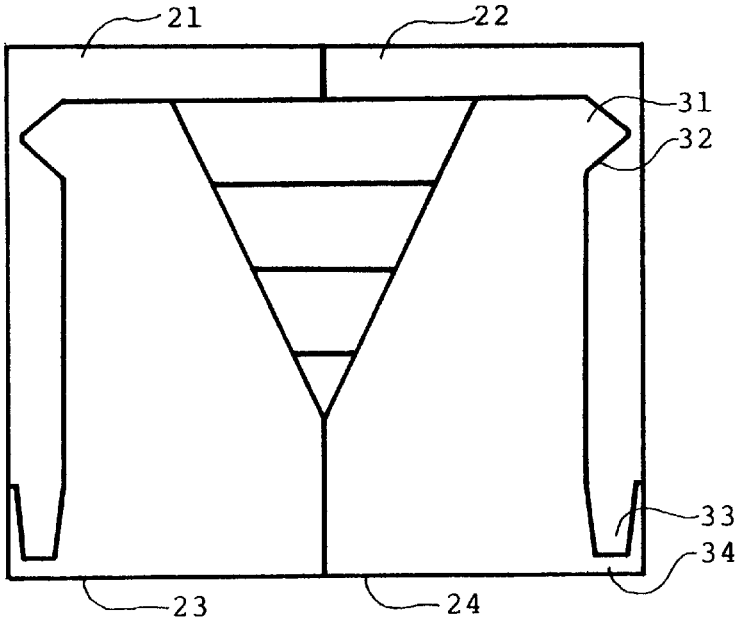
FIG. 9 is a left side view of the domino box taken on line 9.
Figure 10:
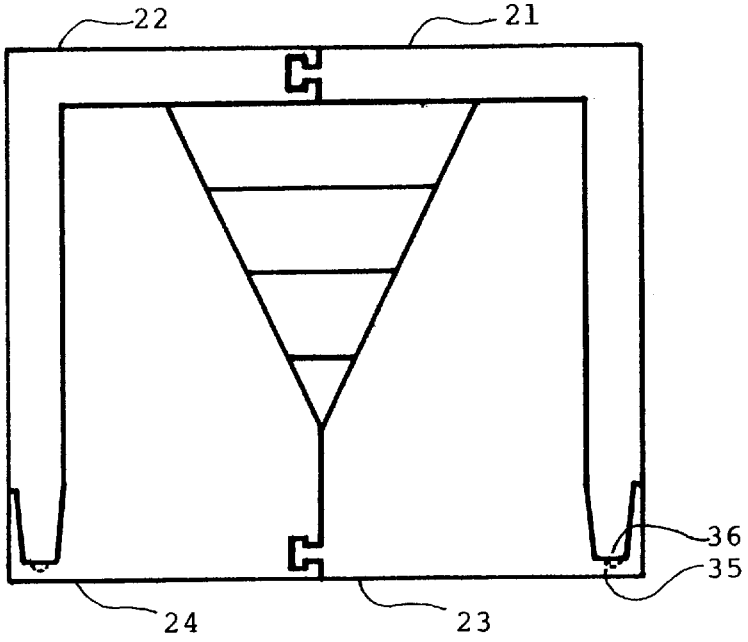
FIG. 10 is a right side of the domino box view taken on the plane of line 10.

The base 29 and the cover 30, shown together in FIG. 9 and FIG. 10, has an upper slidable track system 31–32 and a bottom slidable track system 33–34 for holding them together when the box 20 has been closed. The base 29 and the cover 30 include in their bottom tracks 33–34 a half moon interlock system 35–36 for securing them together.

Figure 8:
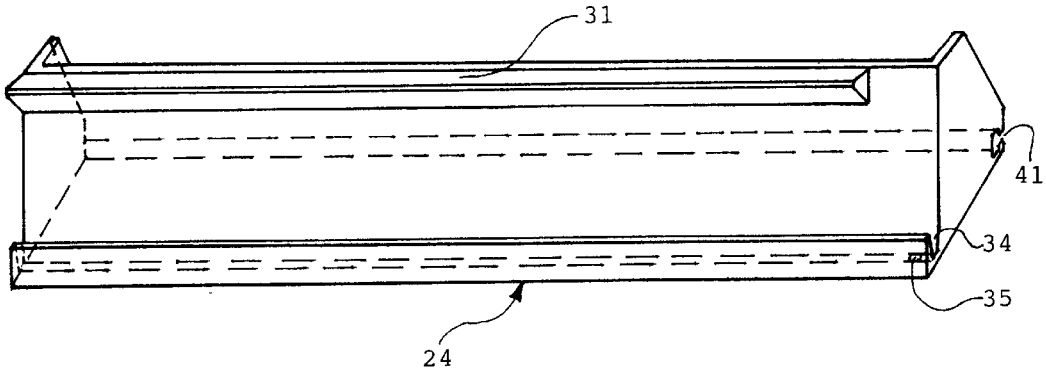
FIG. 8 is a perspective view of a base section, showing an upper male track member, a bottom female track member and a female half moon lock member.

A section of the base 24 shown in FIG. 8 has on its outside surface the upper slidable male track member 31 that is shorter than the base length to facilitate the cover 30 entrance when the box 20 has been closed. The base 29 also includes the bottom slidable female track member 34 which includes the female half moon lock member 35.

Figure 7:
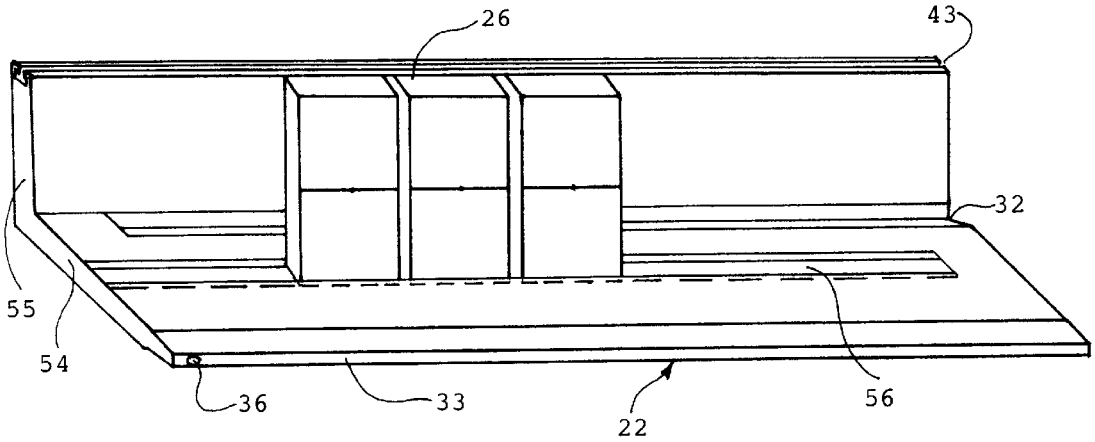
FIG. 7 is a perspective view of a cover domino stand in a playable position, showing the domino tile engaging groove.

A section of the cover 22, shown in FIG. 7, has in its inside surface the upper slidable female track member 32, shorter than the cover 30 length to finalize the sliding movement of the cover 30 when the box 20 has been closed. The cover 30 also includes the bottom slidable male track member 33 which includes the male half moon lock member 36.

Figure 4:
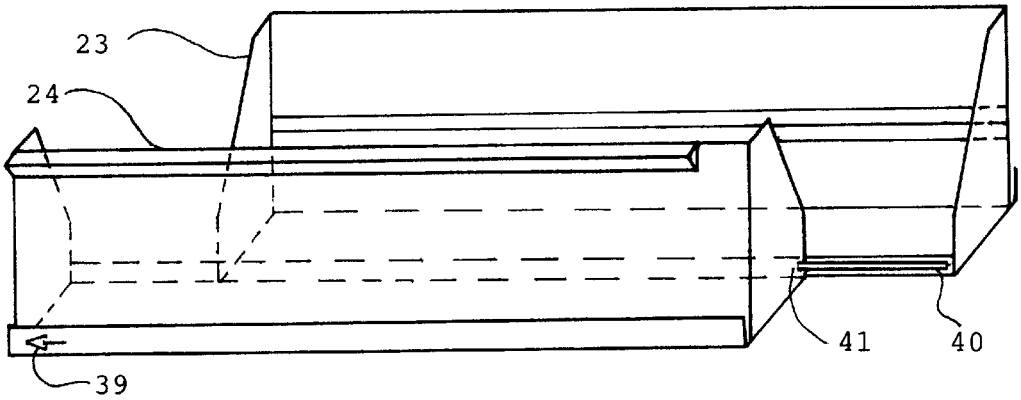
FIG. 4 is a perspective view of the base when it is taken apart, showing a male and female slidable track system.
Figure 11:
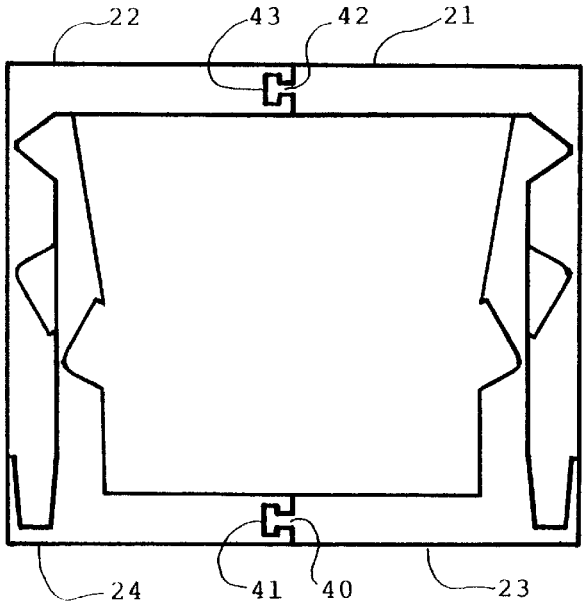
FIG. 11 is a cross-sectional of the domino box view taken the plane of line 11.

The base 29, shown in FIG. 4, has two separate sections. A base section 24 includes an arrow 39 on its outside vertical surface to indicate the base sections sliding disassembling position. The base section 24 has a female track member 41, and the base section 23 has a male track member 40 for connecting the base sections together by a male and female slidable track system, also shown in FIG. 11.

Figure 5:
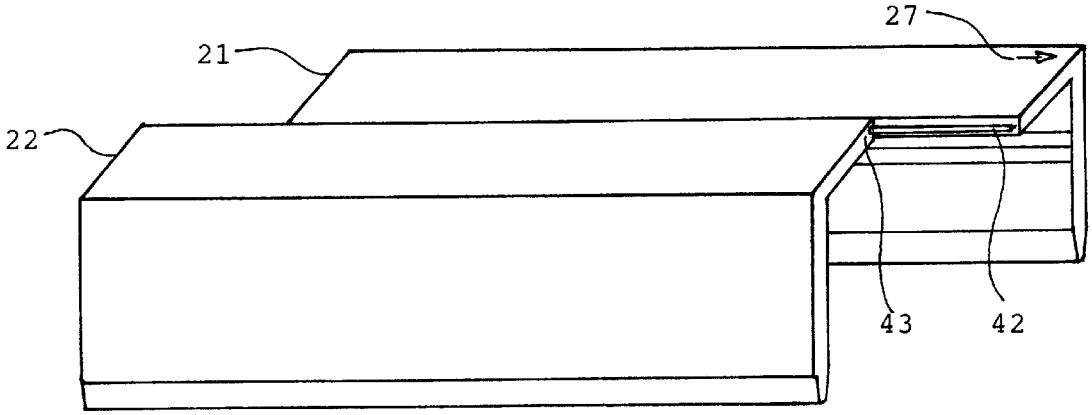
FIG. 5 is a perspective view of the cover when it is taken apart.

The cover 30, shown in FIG. 5, has two separate sections. A cover section 21 includes an arrow 27 on its outside surface to indicate the cover 30 sliding disassembling position and the cover 30 sliding position to open the box 20. The cover section 21 has a male slidable track member 42, and a cover section 22 has a female slidable track member 43 for connecting the cover section by a male a female slidable track system, also shown in FIG. 11.

The cover section and the base sections, when taken apart, collapsing the domino box shown in FIG. 6, are used as domino stands for supporting the domino games tiles 26 when the game is being played.

Figure 12:
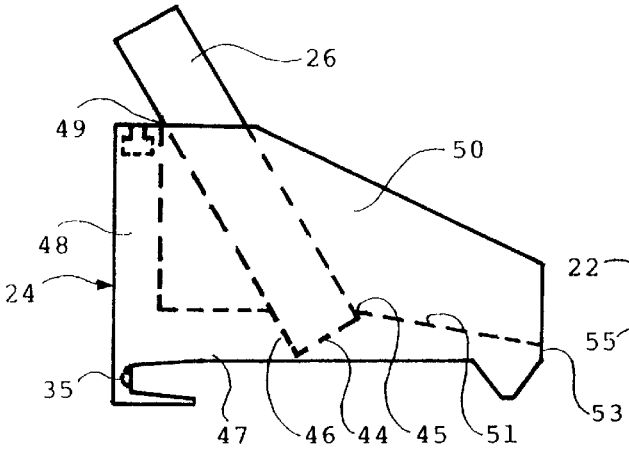
FIG. 12 is a side elevation view of a base domino stand, wing a domino game tile in the domino tiles engaging groove.

The base domino stand 24, shown in FIG. 12, has a horizontal section or base 47 and a vertical section or support 48. The horizontal section 47 has a top surface 51 which includes a domino game tiles engaging groove 44 running generally parallel to the major axis of the front edge 53. The groove 44 is made at an angle 46 which supports in a leaning position the domino tiles 26 against the top edge 49 of the vertical support 48. The groove 44 has a front lip 45 in the front and a domino tile stopper 50 at each end to secure the domino game tiles 26 in place, preventing them from falling by table movements or hand accidents.

Figure 13:
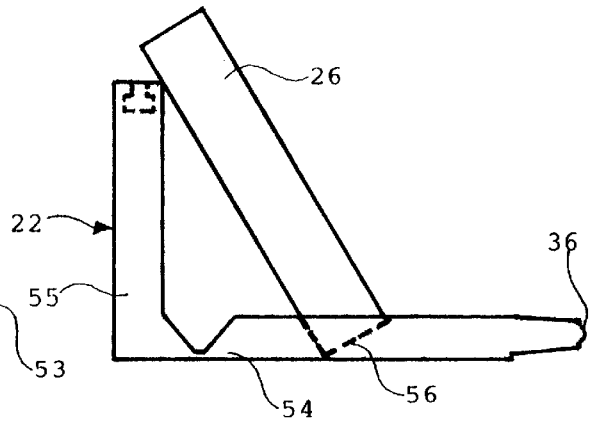
FIG. 13 is a side elevation view of a cover domino stand.

The cover domino stand 22, shown in FIG. 13, has a horizontal section or base 54 and a vertical section or support 55. The horizontal section 54 has a domino tiles engaging groove 56 with the same specifications as the groove 44, described above, but the groove 56 is shorter than the cover length to facilitate the cover 30 entrance over the base 29 when the box 20 has been closed, shown in FIG. 7.

OPERATION

The domino games are usually played by two or four players. Here is the way to take apart the domino box 20 and prepare the game to be played.

To open the domino box 20, shown in FIG. 1, the player should hold the base 29 in the palm of his left hand and slide the cover 30 with his right hand in the direction of the arrow 27 on its outside surface. After the base 29 and the cover 30 are separated, shown in FIG. 2 and FIG. 3, respectively, the player pulls out the score book 37 and the writing instrument 38, then removes the domino games tiles 26.

Now, the players will separate the base sections, shown in FIG. 4, and the cover sections, shown in FIG. 5, in order to use them as domino stands to support the domino tiles 26 while they are playing the game. To separate the base sections, the player should hold with his right hand the base section 23 and with his left hand slides the base section 24 in the direction of the arrow 39 on its outside vertical surface. To separate the cover sections, the player should hold with his left hand the cover section 22 and with the right hand slides the cover section 21 in the direction of the arrow 27 on its outside top surface.

Each player picks up a section as a domino stand to support his domino tiles, shown in FIG. 6. The players place the base of the stand, the section which includes the engaging groove, on the table, and mixes the domino tiles 26 well to start playing.

The players who pick up the base domino stands 23 and 24, shown in FIG. 6, place their domino tiles 26 in the engaging groove 44 which is made at an angle 46 for supporting the domino tiles 26 in a leaning position against the top edge 49 of the vertical support 48. The groove 44 has the front lip 45 running lengthwise and a domino tile stopper 50 at each end to secure the domino tiles 26 in place.

The players who pick up the cover domino stands 21 and 22, shown in FIG. 6, place their domino tiles 26 in the engaging groove 56 which has similar specifications as the groove 44, described above, but the groove 56 is shorter than the length of the cover 30 to facilitate the entrance of the cover 30 over the base 29 when the box 20 has been closed.

The preferred embodiment of the present invention, a domino box kit, has many advantages like: the box transforms into four domino stands, the box carried inside the domino game tiles, the score book and the writing instrument, and it includes a window at each end to show the domino game tiles as well as the color contrast between them and the domino box.

This box can be manufactured out of wood, plastic or another suitable material. While there has been shown and described the domino box kit, it is understood that changes in structure, material, sides shapes and attachment systems can be made by those skilled in the art without departing from the invention. The invention is defined in the following claims.

I claim:

1. A domino box kit comprising: a sectionalized base separable into separate base sections, having a recessed area for storing a plurality of domino game tiles; a sectionalized cover separable into separate cover sections; and attachment means for connecting said base sections and cover sections, whereby said base sections and cover sections when taken apart, collapsing said domino box, are used as domino stands for supporting said domino game tiles in upright position when the game is played.

2. The domino box of claim 1, wherein said domino box is made out of plastic.

3. The domino box kit of claim 1, wherein each of said domino stands has a horizontal section or base and a vertical section or support, said horizontal section has a domino game tiles engaging groove on its upper surface running lengthwise, made at an angle which supports said domino game tiles in a leaning position against said support.

4. The domino box kit of claim 3, wherein said domino tiles engaging groove has a front lip running lengthwise and a domino tiles stopper at each end for securing said domino game tiles in said domino tiles engaging groove.

5. The domino box kit of claim 1, wherein said attachment means for connecting said base sections and cover sections comprises at least a set of male and female track system for connecting said base sections, and at least a set of male and female track system for connecting said cover sections.

6. The domino box kit of claim 1, further including at least two sets of male and female track systems for holding said base and cover when the box had been closed.

7. The domino box kit of claim 1, further including an interlock system at said base and cover for securing thereof when the box had been closed.

8. The domino box kit of claim 1, further including a score book to be carried inside said domino box.

9. The domino box kit of claim 1, further including a writing instrument to be carried inside said domino box.

10. The domino box kit of claim 1, further including a window at each end for exposing said domino game tiles.

11. A domino box kit comprising: a base, having a recessed area for storing a plurality of domino game tiles; and a cover, said base having two separate sections, one base section having a male track member and the other base section having a female track member, for connecting said base sections by a male and female track system, said cover having two separate sections, one cover section having a male track member and the other cover section having a female track member for connecting said cover sections by a male and female track system, whereby said cover sections and base sections when taken apart, collapsing said domino box, are used as domino stands for supporting said domino game tiles when the game is played.

* * * * *